US005406041A

United States Patent [19]

Hahn et al.

[11] Patent Number: 5,406,041

[45] Date of Patent: Apr. 11, 1995

[54] ROTARY VACUUM VALVE AND ELECTRIC SWITCH ASSEMBLY

[75] Inventors: Sangman Hahn, Carmel; Michael L. Molinari, Kokomo, both of Ind.

[73] Assignee: Delco Electronics Corp, Kokomo, Ind.

[21] Appl. No.: 149,398

[22] Filed: Nov. 9, 1993

[51] Int. Cl.[6] ..... H01H 9/06

[52] U.S. Cl. ..... 200/61.86; 200/11 J; 200/16 C

[58] Field of Search ..... 200/11 R, 11 A, 11 G, 200/11 J, 16 R, 16 A, 16 C, 17 R, 18, 61.85, 61.86; 137/624.18, 625, 625.11

[56] References Cited

U.S. PATENT DOCUMENTS 4,730,090 3/1988 Raab et al. ..... 200/115

4,892,984 1/1990 Clark et al. ..... 200/61.86

5,250,770 10/1993 Cummings ..... 200/295

*Primary Examiner*—A. D. Pellinen

*Assistant Examiner*—Michael A. Friedhofer

*Attorney, Agent, or Firm*—Jimmy L. Funke

[57] ABSTRACT

A two-piece housing defines a cavity containing electric switch elements and a detent mechanism positioned for optimum characteristics. Axially spaced apertures in the housing support a manually controlled shaft for rotation. The shaft is drivingly coupled to the movable switch elements and the detent mechanism. A floating valve assembly, operated by the shaft and aligned by the shaft, is mounted on the outside of the housing on projections which flexibly support a valve stator containing vacuum ports. A rotor holds a selector plate against the stator for interconnecting ports. The rotor is keyed to the shaft for rotation and is spring biased toward the stator.

14 Claims, 2 Drawing Sheets

ROTARY VACUUM VALVE AND ELECTRIC SWITCH ASSEMBLY

FIELD OF THE INVENTION

This invention relates to a combination vacuum valve and electric switch for rotary operation.

BACKGROUND OF THE INVENTION

An automotive heating, ventilating and air conditioning system is subject to control by electrical switching and often by vacuum valve operation. A control panel advantageously employs a single rotary knob for selection of the mode of operation. Such modes may be, for example, Off, Vent, Bi-level, Heater, Blend and Defrost. It is already known to use a combination vacuum valve and electric switch rotatably positioned by the single knob.

FIG. 1 illustrates such a prior art switch/valve assembly. A generally cup-shaped housing 10 has an aperture 12 surrounded by an inner hub 14 which rotatably supports a carrier shaft 16. Fixed switch conductors 18 are secured to the inner face of the housing and end in terminals 20. A cylindrical inner surface of a circumferential wall of the housing is provided with detent teeth 22.

A carrier 24 supported by the shaft 16 has a radially spring biased detent ball 26 for engaging the teeth 22, and a movable spring loaded contact assembly 28 for selectively engaging the switch conductors 18. An E-ring 30 is clipped onto the shaft 16 just outside the housing to hold the shaft against inward movement. The outer end of the shaft may be provided with a control knob. Thus, the switch may be operated to different positions by rotating the shaft to those positions determined by the detent mechanism.

The vacuum valve arrangement in FIG. 1 comprises a stator 32 assembled to the housing 10 as by snap-on spring fingers 34. The stator has a plurality of vacuum ports 36 with outwardly protruding coupling tubes 38. A molded plastic rotor 40 holds a rubber selector plate 42 against the inner side of the stator 32. Surface passageways on selector plate 42 selectively interconnect ports 36 at each position. A snap-in pivot pin 44 extends through central holes in the stator, the selector plate and the rotor.

A spring 46 compressed between a head of the pin 44 and the rotor holds the valve assembly together in sealing relationship. Drive pins 48 on the rotor 40 engage notches in the carrier 24 to rotate the rotor with the carrier. Barbed posts 50 on the stator 32 retain a sealing grommet, not shown, which aids in connection to the vacuum system.

Due to the location of the detent teeth 22 on the wall of the housing 10 and the large radius of the wall, the teeth cannot have sufficient slope to provide a crisp feel and at the same time to minimize the possibility of the switch being positioned between discrete modes. To obtain steeper slopes it is desirable to locate the teeth on a smaller radius. It is already known, in a valve having no electrical switch, to locate the teeth at the desired radius on the end wall of the housing 10 in lieu of the conductors 18. The presence of the switch, however, prohibits that structure.

Due to the mounting geometry of the shaft within the housing, undesired wobble of the shaft can occur. While the inner hub 14 helps stabilize the shaft, the hub can not be made deep enough to prevent the wobble. Also, to retain the shaft, an E-ring or other fastener is required.

As is common with injection molded components, the rotor has some warpage on the surface that mates with the selector plate, and has an adverse effect on sealing between the selector plate and the stator which leads to vacuum leakage. Such warpage is aggravated by the force exerted by the grommet on the barbed posts 50.

SUMMARY OF THE INVENTION

It is therefore an object of the present invention to provide a vacuum valve and electric switch assembly which eliminates the problems of rotor warpage and shaft wobble, and provides optimum detent feel for the switch operator.

Another object is to provide in such an assembly a self-aligning valve structure to improve the seating between stator and rotor parts. Isolating the parts from external stress is also addressed.

The invention is carried out by a combination of features which involve two separate housing members, herein called a terminal housing and a detent housing, which together permit stable, two-point shaft mounting and the detent housing presents a preferred location for detent teeth, thereby affording robust quality and good detent feel. The detent housing directly supports the grommet to avoid grommet stress on the stator or any valve part.

The shaft is used to align the rotor and the stator as well as to directly drive the rotor. A floating valve structure including the rotor, selector plate and the stator is employed to assist in alignment, as well as to prevent the induction of stress. A light spring force is applied to the rotor to maintain seating engagement at the selector plate/stator interface; otherwise, only shaft torque is applied to the rotor.

BRIEF DESCRIPTION OF THE DRAWINGS

The above and other advantages of the invention will become more apparent from the following description taken in conjunction with the accompanying drawings wherein like references refer to like parts and wherein.

DESCRIPTION OF THE INVENTION

Figure 1:
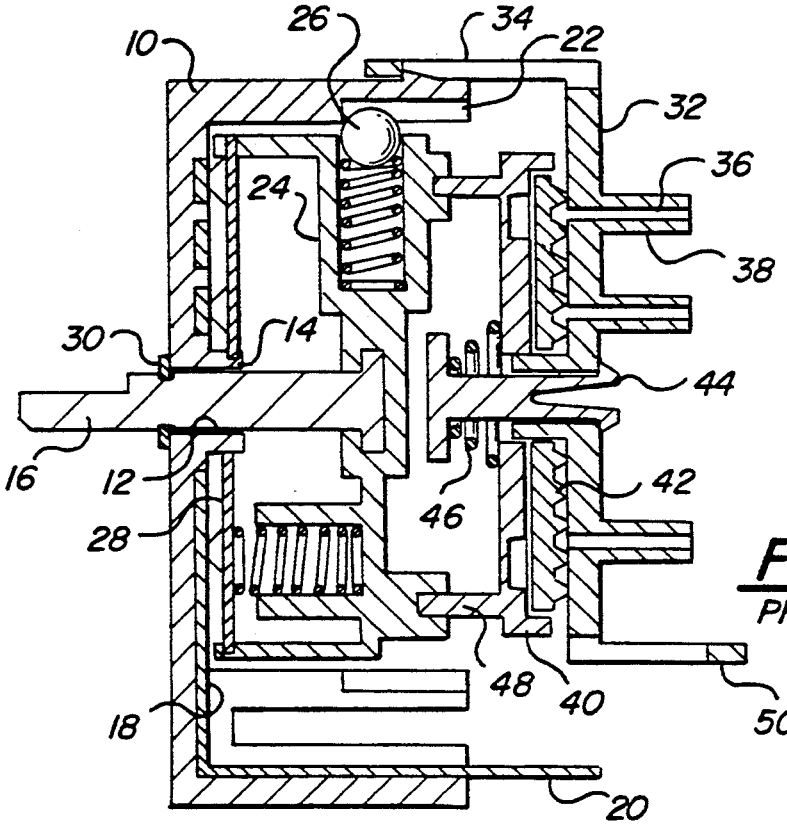
FIG-1 PRIOR ART
FIG. 1 is a cross section of a prior art combined vacuum valve and electric switch arrangement.
Figure 2:
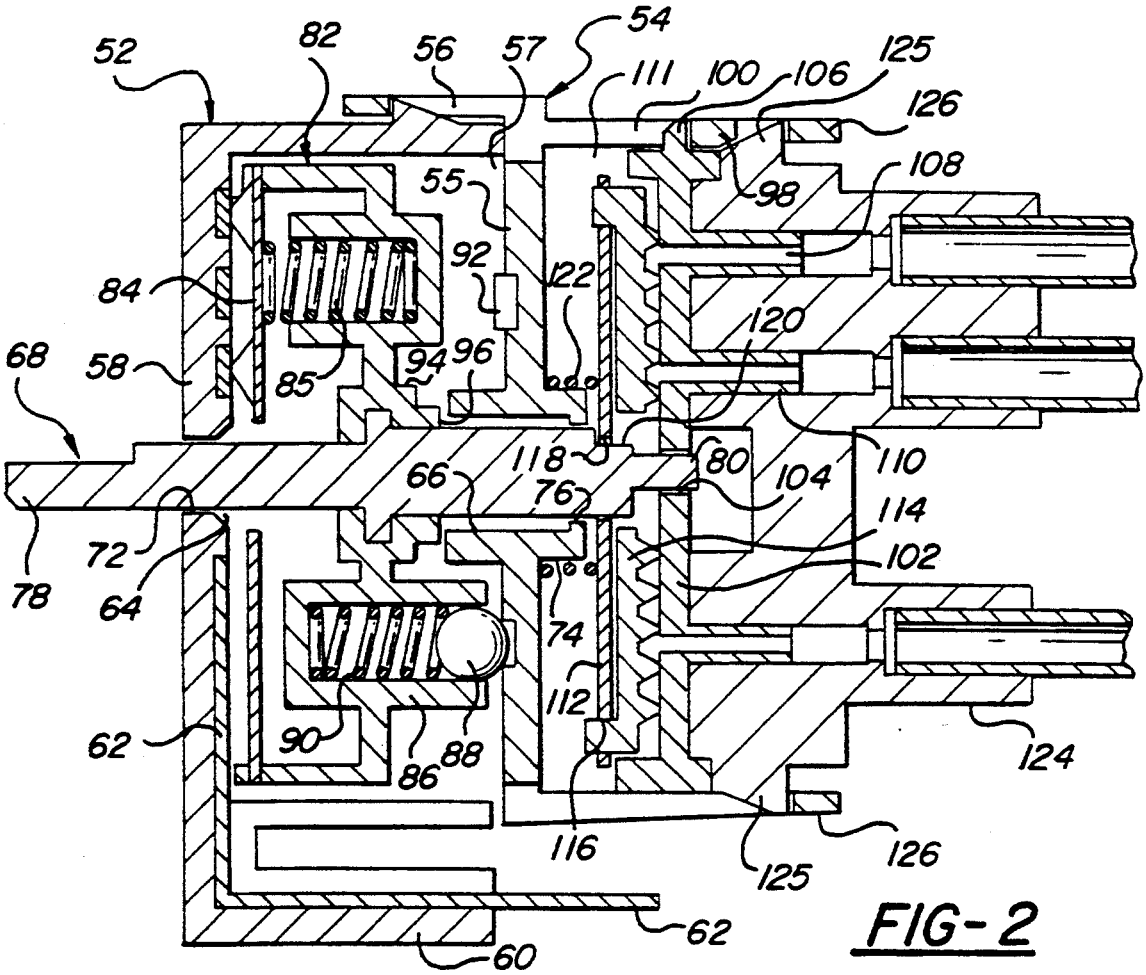
FIG. 2 is a cross section of a combined vacuum valve and electric switch assembly, according to the invention.
Figures 3, 4:
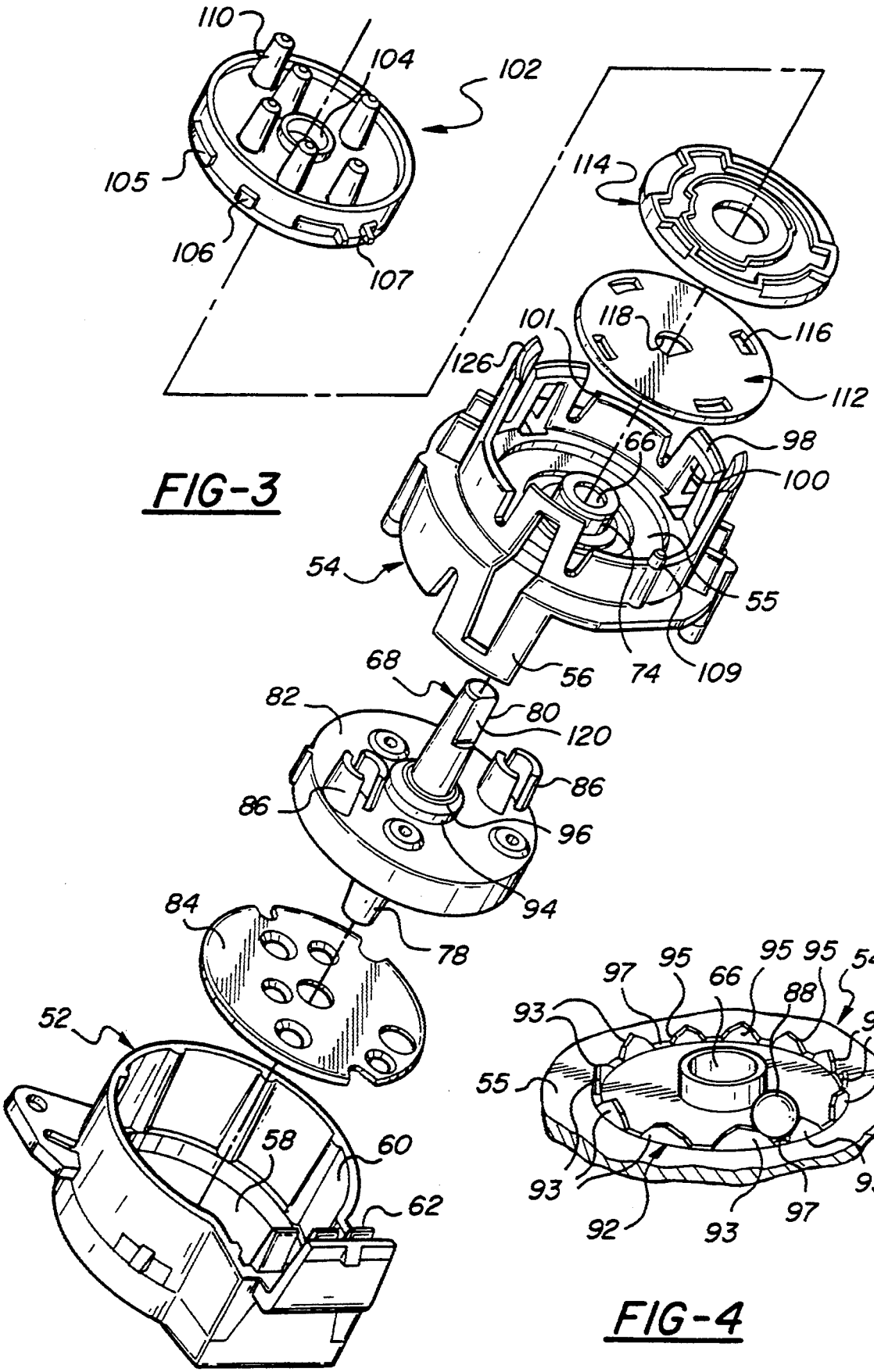
FIG. 3 is an exploded view of the assembly of FIG. 2 omitting springs and a detent ball.
FIG. 4 is a view of a detent detail formed on one element of the assembly of FIG. 2, according to the invention.

Referring to FIGS. 2 and 3, an electric switch and vacuum valve assembly has a pair of molded plastic housing members comprising a terminal housing 52 which is generally cup-shaped having an open end, and a detent housing 54 having a detent end wall 55 covering the open end of the terminal housing and secured to the terminal housing by snap-on fingers 56, thus defining a cavity 57. The terminal housing 52 has a terminal end wall 58 and a generally cylindrical side wall 60.

A plurality of switch conductors or terminals 62 are carried on the inner surfaces of the end and side walls and protrude beyond the side wall for coupling to a connector. Aligned apertures 64 and 66 in the end walls 58 and 55, respectively, define an axis of rotation of a carrier shaft 68. The aperture 64 defines an inner journal 72 at its outboard end for rotatably supporting the shaft 68, and a hub 74 around the aperture 66 similarly has an inner journal surface 76 at its outboard end also supporting the shaft. The shaft is thus stable and free from wobble because it is journalled at two spaced points.

The shaft 68 extends through the apertures and protrudes at one end 78 beyond the terminal housing 52 to receive a control knob, not shown, and also protrudes at the other end 80 beyond the detent housing 54, the end 80 having a reduced diameter. A carrier 82, molded onto the shaft 68 intermediate its ends for rotation with the shaft, is located in the cavity 57. The carrier 82 supports a switch contact assembly including a movable contactor 84 and springs 85 for biasing the contactor 84 against the terminals 62, the contactor making selective bridging contact with the terminals according to the rotational shaft position.

Either one of a pair of tubular detent pockets 86 on the carrier 82 holds a detent ball 88 and a spring 90 for biasing the ball in an axial direction toward the detent housing end wall 55. The carrier is held between the two housings by the opposing spring action of the contactor springs 85 and the detent springs 90. The hub 94 of the carrier has an annular face 96 for abutment with the inboard end of the hub 74, thereby serving as a thrust bearing for the shaft 68 against the detent housing 54 for axial loads exerted by springs 85 and the operator knob push-in force on the shaft 68.

As best shown in FIG. 4, which displays only a portion of the detent housing 54, an annular toothed cam surface 92 molded on the inner face of the detent housing end wall 55 coaxial with the aperture 66, engages the ball 88 as the carrier moves upon shaft rotation. Typically, the rotary assembly is rotatable 180 degrees and, depending on the application, has from five to eight detent positions throughout its range of movement. The form of the cam surface 92 then controls the detent positions.

To minimize the number of different detent housings required for a range of applications, the annular array of teeth on the cam surface has two segments of teeth 93 and 95, one segment on each side of the housing, and each encompassing 180 degrees. The segment of teeth 93 has six detent positions and the segment of teeth 95 has eight detent positions, the two segments sharing common terminal positions 97. The segments of teeth 93 and 95 are aligned with the range of movement of the two detent pockets 86, but only one of the pockets 86 contains a detent ball 88. Thus, depending on which pocket 86 contains the ball 88, the assembly will have either six or eight detent positions.

The spacing of the ball and cam surface from the axis and the profile of the detent teeth are selected to optimize the detent feel and operation and depends on the number of teeth per segment.

The vacuum valve assembly is mounted outboard of the detent housing 54 and is supported by the end 80 of the shaft 68 and by axial flexible fingers 98 projecting from the detent housing, the fingers having slots 100. The fingers 98 are part of a generally cylindrical wall 101 extending outwardly from the detent housing.

A molded stator 102 has a central guide aperture 104 fitting over the shaft end 80 and tabs 106 on its periphery to engage the slots 100 in the fingers 98. Spaced locator tabs 107, bracket a post 109 on the detent housing 54 for holding the stator against rotation. Stoppers 105 extend from the rim of the stator to abut the top of the wall 101 for limiting the axial movement of the stator. Thus, the stator 102 is loosely held by the fingers 98 and is axially aligned by coaction with the reduced shaft end 80. Vacuum ports 108 are formed in the stator and port tubes 110 extend outward to make connection with the vacuum system. The stator 102 and the detent housing 54, including the wall 101, define a second cavity 111.

A rotor assembly within the cavity 111 comprises a rotor 112 and a rubber selector plate 114 carried by the rotor for sliding engagement with the inner surface of the stator 102 upon shaft rotation. The selector plate 114 has surface passages for selectively interconnecting ports 108. The rotor 112 comprises a flat metal plate, not subject to warpage as are prior plastic rotors, having outer drive apertures 116 engaging the selector plate 114 and a central aperture 118 slidably mounted on the shaft 68 and keyed to a flat 120 on the shaft to effect rotation with the shaft. The shaft thus axially aligns the rotor with the stator and allows the rotor to move axially.

A coil spring 122 is compressed between the outer face of the detent housing 54 and the rotor 112, surrounding the hub 74 and slidably rotating against housing 54 upon rotation of rotor 112. The coil spring applies a light pressure sufficient to urge the selector plate 114 into sealing engagement with the stator 102. Thus, the valve parts are flexibly mounted to facilitate self-alignment, through the shaft, and axial movement under light spring force, limited by the slots 100 of the fingers 98.

A grommet 124, for aiding the sealing coupling of the port tubes 110 to the vacuum system, has tabs 125 engaged by support fingers 126 on the detent housing 54 which extend laterally of the stator 102. Any force imposed by the grommet is taken up by the detent housing and is not applied to the vacuum valve assembly.

It will thus be seen that the unique structure of this switch/valve assembly, employing terminal and detent housings and incorporating separate cavities for switch and valve structures, affords a robust assembly with stable shaft support, a flat rotor free of warpage, and a vacuum valve portion free of external forces tending to induce warpage. In addition, this design provides freedom to optimize the detent mechanism and eliminates an E-ring to reduce assembly cost.

The embodiments of the invention in which an exclusive property or privilege is claimed are defined as follows:

1. A rotary vacuum valve and electric switch assembly comprising:

a housing including first and second molded housing members assembled to define a first cavity having a central axis, each member having an end wall containing an aperture aligned with the axis;

a carrier in the first cavity having a manually operable shaft journalled in the apertures for rotation on the axis and extending externally of both members;

electrical switch means supported within the first cavity for operation by the carrier upon rotation of the shaft;

a detent mechanism within the first cavity comprising cooperating detent portions on the carrier and on the end wall of the second housing member, respectively, to provide a detent operation for the carrier;

a generally cylindrical side wall member extending outwardly of the second housing member;

a stator spaced from the second housing member and supported by the side wall member to define a second cavity, the stator including a plurality of vacuum ports;

a rotor in the second cavity slidably mounted on the shaft and keyed to the shaft for rotation therewith; and a selector plate carried by the rotor and slidably biased against the stator for selectively coupling vacuum ports at different rotary positions.

2. The invention as defined in claim 1, wherein the electrical switch means comprises conductors fixed inside of the first housing and movable contact means carried by the carrier for selective engagement with the conductors.

3. The invention as defined in claim 1, wherein the detent mechanism includes an annular toothed cam surface coaxial with the axis and integral with the end wall of the second housing member, and a ball on the carrier and biased against the cam surface for movement along the cam surface upon carrier rotation.

4. The invention as defined in claim 1, wherein the stator is loosely held by the side wall member of the second housing to allow movement in the radial direction; and the stator includes a central aperture encompassing the shaft for location by the shaft, whereby the stator is aligned with the shaft and thus with the rotor and selector plate.

5. The invention as defined in claim 4, wherein the selector plate is biased against the stator by a spring compressed between the second housing and the rotor.

6. The invention as defined in claim 1 including grommet support means projecting axially from the second housing laterally of the stator.

7. A combination rotary vacuum valve and electrical switch assembly comprising:

a generally cup-shaped terminal housing having a first end wall and an open end opposite the end wall;

a detent housing assembled to the open end of the terminal housing and having a second end wall spaced from the first end wall to form a cavity;

aligned apertures in the first and second end walls defining an axis;

stationary switch conductors secured to the inner surface of the first end wall;

first detent means on the inner surface of the second end wall;

a shaft extending through the apertures and journalled therein for rotation on the axis;

a carrier mounted on the shaft for rotation therewith within the cavity and carrying movable switch contacts for selectively engaging the switch conductors of the first end wall and second detent means for cooperatively engaging the first detent means on the second end wall;

a stator supported by the detent housing at a position spaced from the second end wall and containing a plurality of vacuum ports; and a rotor assembly between the second end wall and the stator and driven by the shaft for selectively coupling the vacuum ports.

8. The invention as defined in claim 7 including:

a plurality of projections extending from the detent housing for loosely holding the stator;

means for aligning the stator and the rotor assembly; and a spring compressed between the second wall and the rotor assembly for biasing the rotor assembly against the stator.

9. The invention as defined in claim 8, wherein the means for aligning the stator and the rotor assembly comprises central apertures in both the stator and the rotor assembly mating with the shaft, whereby both the stator and the rotor assembly are aligned with the axis.

10. The invention as defined in claim 7, wherein the rotor assembly and the stator each have a central aperture slidably mating with the shaft, whereby the stator and the rotor assembly are mutually aligned.

11. The invention as defined in claim 7 including:

first projection means extending axially from the detent housing for supporting the stator;

a grommet for making a sealing coupling to the vacuum ports of the stator; and second projection means extending axially from the detent housing for retaining the grommet.

12. The invention as defined in claim 7, wherein the first detent means comprises an annular array of detent teeth, a first segment of the array comprising a first number of detent positions and a second segment of the array comprising a second number of detent positions; and the second detent means being mounted for rotation in contact with one of either segment of the annular array of teeth, whereby the number of detent positions is determined according to which segment is contacted by the second detent means.

13. The invention as defined in claim 12 wherein both segments are semicircular and are joined at common detent positions; and the second detent means is mounted for rotation through a semicircular arc.

14. The invention as defined in claim 12, wherein the carrier includes a pair of diametrically opposed detent pockets, each pocket positioned for moving over an arcuate range juxtaposed with a different one of the segments of the array of detent teeth when the shaft is rotated; and the second detent means comprises a ball in one of the pockets and biased toward the second end wall to serially engage the detent teeth in one segment of the array of detent teeth.

* * * * *